US011359822B2

(12) United States Patent
Blad et al.

(10) Patent No.: US 11,359,822 B2
(45) Date of Patent: Jun. 14, 2022

(54) CIRCULATION PUMP ASSEMBLY

(71) Applicant: GRUNDFOS HOLDING A/S, Bjerringbro (DK)

(72) Inventors: Thomas Blad, Bjerringbro (DK); Christian Blad, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 0 days.

(21) Appl. No.: 16/635,787

(22) PCT Filed: Aug. 2, 2018

(86) PCT No.: PCT/EP2018/070968
§ 371 (c)(1),
(2) Date: Jan. 31, 2020

(87) PCT Pub. No.: WO2019/025525
PCT Pub. Date: Feb. 7, 2019

(65) Prior Publication Data

US 2020/0340684 A1 Oct. 29, 2020

(30) Foreign Application Priority Data

Aug. 3, 2017 (EP) ..... 17184776

(51) Int. Cl.
*F24D 3/02* (2006.01)
*F24D 3/10* (2006.01)
(Continued)

(52) U.S. Cl.
CPC ..... *F24D 3/02* (2013.01); *F04D 1/006* (2013.01); *F04D 13/14* (2013.01);
(Continued)

(58) Field of Classification Search
CPC ..... F24D 3/105; F24D 2220/0207; F24D 2220/0271; F24D 29/4293; F24D 1/006;
(Continued)

(56) References Cited

U.S. PATENT DOCUMENTS 4,678,409 A * 7/1987 Kurokawa ..... F04D 13/024 417/420
5,246,336 A * 9/1993 Furukawa ..... F04D 29/426 415/102
(Continued)

FOREIGN PATENT DOCUMENTS

DE 11 19 485 B 12/1961
DE 1119485 B * 12/1961 ..... F24D 3/105
(Continued)

*Primary Examiner* — Atif H Chaudry
(74) *Attorney, Agent, or Firm* — McGlew and Tuttle, P.C.

(57) ABSTRACT

A circulation pump assembly includes a first inlet (84), an outlet (80), an electric drive motor (30) and at least one impeller (68; 100) driven by the drive motor (30). The circulation pump assembly has at least one first flow path (26; 48) positioned in a connection between the first inlet (84) and the outlet (80) for increasing the pressure of a fluid. The circulation pump assembly has a second inlet (86). The at least one impeller (68; 100) has at least one second flow path (28; 50) for increasing the pressure of a fluid, which is positioned in a connection of the second inlet (86) to the outlet (80). A heating system is provided having a circulation pump assembly of this type.

20 Claims, 12 Drawing Sheets

(51) Int. Cl.

| | |
|---|---|
| ***F04D 29/42*** | (2006.01) |
| ***F04D 15/00*** | (2006.01) |
| ***F04D 13/14*** | (2006.01) |
| ***F04D 1/00*** | (2006.01) |

(52) U.S. Cl.
CPC ..... *F04D 15/0016* (2013.01); *F04D 15/0022* (2013.01); *F04D 29/4293* (2013.01); *F24D 3/105* (2013.01); *F24D 2220/0207* (2013.01); *F24D 2220/0271* (2013.01); *F24D 2220/042* (2013.01); *Y10T 137/85954* (2015.04); *Y10T 137/86163* (2015.04)

(58) Field of Classification Search
CPC .. F24D 15/0016; F24D 13/14; F24D 15/0022; F04D 15/0016; F04D 29/4293; F04D 1/006; F04D 13/14; F04D 15/0022; F04B 23/04; F04B 49/225; Y10T 137/86163; Y10T 137/85954
See application file for complete search history.

(56) References Cited

U.S. PATENT DOCUMENTS

| | | | | |
|---|---|---|---|---|
| 5,713,729 | A * | 2/1998 | Hong | F04D 15/0022 417/423.14 |
| 6,257,177 | B1 * | 7/2001 | Lehmann | F01P 5/10 123/41.41 |
| 2013/0183137 | A1 * | 7/2013 | Murray | F04D 1/08 415/100 |
| 2017/0356449 | A1 * | 12/2017 | Blad | F04D 29/4293 |

FOREIGN PATENT DOCUMENTS

| | | | | |
|---|---|---|---|---|
| DE | 21 07 000 | A1 | 8/1972 | |
| DE | 690 04 616 | T2 | 5/1994 | |
| DE | 10 2004 059567 | A1 | 6/2006 | |
| DE | 102004059567 | A1 * | 6/2006 | F24D 19/1006 |
| EP | 2 871 420 | A1 | 5/2015 | |

* cited by examiner

CIRCULATION PUMP ASSEMBLY

CROSS REFERENCE TO RELATED APPLICATIONS

This application is a United States National Phase Application of International Application, PCT/EP2018/070968, filed Aug. 2, 2018, and claims the benefit of priority under 35 U.S.C. § 119 of European Application 17 184 776.7, filed Aug. 3, 2017, the entire contents of which are incorporated herein by reference.

TECHNICAL FIELD

The invention relates to a circulation pump assembly as well as to a heating system with such a circulation pump assembly.

TECHNICAL BACKGROUND

In heating systems, circulation pump assemblies are used in order to circulate a fluid heat-transfer medium or a heating medium, in particular water, through the heating system. If in heating systems one uses heating circuits which require different feed temperatures, it is common to provide mixers which can reduce the feed temperature for certain heating circuits, for example heating circuits of a floor heating. Such mixers are often applied in combination with compact heating boilers which apart from a heat source such as a heating boiler with a primary heat exchanger, also already comprise a circulation pump assembly for circulating the heat-transfer medium through the heating system. This circulation pump assembly provides a residual delivery head which is adapted such that it is sufficient for a conventional heating circuit with radiators and thermostat valve. As a rule, a second circulation pump assembly which is arranged downstream of a mixing valve, via which valve the heated heat transfer medium is injected out of the heating boiler into a heating circuit with a lower feed temperature, is then used for this further heating circuit with a reduced feed temperature. Here, it is necessary to reduce the preliminary pressure which is provided in the boiler by the circulation pump assembly, in the mixing valve or a valve arranged upstream, to the pressure level at the inlet side of the circulation pump assembly in the second heating circuit. I.e. the residual delivery head which is provided in the heating boiler by the circulation pump assembly is destroyed and an energy loss occurs.

SUMMARY

The circulation pump assembly according to the invention in particular is designed as a heating circulation pump assembly for application in a heating facility, wherein a heating facility in the context of this invention is also to be understood as an air-conditioning facility which does not serve for heating but for cooling. Very generally, the circulation pump assembly according to the invention can be used for circulating a fluid heat transfer medium or heating medium for the temperature adjustment of a building or a facility.

The circulation pump assembly according to the invention comprises a first inlet, i.e. a first suction inlet, as well as an outlet. The outlet is a delivery outlet, through which the fluid exits out of the circulation pump assembly. The circulation pump assembly moreover comprises an electrical drive motor which rotatingly drives at least one impeller (an impeller arrangement comprising at least one impeller) which is provided in the circulation pump assembly. I.e. the circulation pump assembly is a centrifugal pump assembly. The electrical drive motor is particularly preferably configured as a wet-running electrical drive motor, i.e. as a motor with a can or can pot between the rotor and the stator. The at least one impeller is arranged in the circulation pump assembly in a connection or flow connection between the first inlet and the outlet. The impeller comprises at least one flow path in this flow connection and serves for the pressure increase of a fluid. The impeller can therefore deliver a fluid, e.g. a fluid heating medium, from the first inlet and to the outlet and increase the pressure of the fluid between the inlet and outlet. The at least one flow path through the impeller can be formed for example by way of the usual channels between the impeller blades.

According to the invention, the circulation pump assembly comprises a second inlet, wherein a second flow connection from this second inlet to the outlet is formed in the circulation pump assembly. The second inlet thus forms a second suction inlet or suction branch, wherein a different pressure level than at the first inlet can prevail at the second inlet on operation of the circulation pump assembly. The at least one impeller moreover comprises at least one second flow path with a pressure increase of a fluid such as a fluid heating medium, wherein this second flow path lies in the described flow connection between the second inlet and the outlet. This means that the circulation pump assembly according to the invention comprises two separate flow paths in the at least one impeller, via which paths a pressure increase can be accomplished. This design permits fluids, such as e.g. two flows of a fluid heating medium which are from the two inlets and which have a different inlet pressure or preliminary pressure at the two inlets, to be increased to the same end pressure at the outlet. I.e. the at least one impeller with the two flow paths is configured such that it produces two different pressure differences on its rotation.

This design according to the invention permits the circulation pump assembly to be used in a heating circuit with a mixer and to feed fluid at a preliminary pressure, i.e. at a residual delivery head, to the second inlet of the circulation pump assembly. This preliminary pressure can be provided for example by a circulation pump in a heating boiler or in a compact heating facility. With this arrangement, the mixing point of the mixer is then situated in the described circulation pump assembly and it is no longer necessary to reduce the preliminary pressure or the residual delivery head at the inlet side of the mixer, in order to achieve the same suction pressure at the suction side of the circulation pump assembly in the heating circuit which is to be supplied via the mixer. In contrast, fluids at two different pressure levels can be fed to the circulation pump assembly according to the invention. The fluid which is to be circulated in the heating circuit to be supplied is fed at the first inlet, whereas the fluid which is with a higher pressure level and which is to be admixed is admixed via the second inlet. The circulation pump assembly according to the invention therefore permits the reduction of energy losses on operation of a mixer. Since the floor heating usually accounts for the greatest share with modern heating systems, energy savings in the region of the circulation pump assemblies of up to 30% can be realized in this manner.

The two separate flow paths in the at least one impeller are preferably configured such that they have a fixed, non-changing cross-sectional ratio to one another. I.e. for changing a mixing ration one preferably does not envisage changing a cross-sectional ratio of the two flow paths. This simplifies the construction since no corresponding valve devices and also no displaceablity of the impeller are necessary. In contrast, a change of the mixing ratio is particularly preferably achieved by a speed change of the at least one impeller, as is described further below.

Preferably, the at least one flow path and the at least one second flow path are arranged in a common impeller. I.e. a pressure increase of the fluid flowing through the two flow paths is effected over these flow paths on rotation of the impeller with these two flow paths. Alternatively, it is possible to use two impellers which are arranged to one another in a rotationally fixed manner and which rotate together. These can be formed as one piece with one another or be rotationally fixedly connected to one another in another manner. For example, an impeller with two blade rings can also be used, wherein a first blade ring defines the first flow paths and a second blade ring defines the second flow paths. Such an impeller can be configured such that the run-ins or inlets for both flow paths are situated at the same axial side, seen in the direction of the rotation axis or also at sides which are opposed to one another in the axial direction. Also on using two impellers, these could be arranged such that the inlet sides or suction openings are directed opposite one another. Such an arrangement has the advantage that the occurring axial forces at least partly cancel one another out.

According to a further preferred embodiment of the invention, it is possible for the at least one second flow path to be formed by a section of the at least one first flow path. Here, the first flow path then comprises a first section, in which only the fluid flowing through the first flow path undergoes a pressure increase. The second inlet runs out into a second section of the first flow path, in which section the fluid which is fed from the second inlet as well as the fluid which exits from the first section of the first flow path then undergoes a pressure increase. I.e., the fluid flow from the first inlet as well as the fluid flow from the second inlet undergoes a pressure increase in the second flow path. If fluid with a preliminary pressure is fed at the second inlet, then this has the advantage that the fluid which is fed at a lower preliminary pressure via the first inlet undergoes a first pressure increase in the first section of the first flow path, so that the fluids from the first and second inlet have essentially the same pressure level at that point, at which the flow runs out from the second inlet into the first flow path.

Further preferably, the at least one impeller comprises a suction port as a first inlet opening, departing from which the at least one first flow path extends to an outlet side of the impeller. The suction port as a first inlet opening is in connection with a first inlet of the circulation pump assembly and the outlet side of the impeller is in connection with the outlet of the circulation pump assembly. The impeller preferably comprises at least one second inlet opening which in the direction of the flow through the impeller is situated between the mentioned suction port and the outlet side. This at least one second inlet opening is connected to the second inlet of the circulation pump assembly. A fluid flow at a greater pressure level can therefore be introduced into the impeller via a second inlet opening, at a position, at which the fluid which is fed through the suction port has already undergone a certain pressure increase in the impeller. On using this circulation pump assembly in a mixer or as a mixer, the mixing point of the two flows therefore lies in the impeller. Thus two fluid flows with a different preliminary pressure can be mixed at a mixing point with an essentially equal pressure level without the greater pressure in one of the two fed fluid flows firstly having to be reduced. The energy loss can be minimized by way of this.

The second inlet opening preferably runs out into a first flow path, wherein the section of the at least one first flow path simultaneously forms the at least one second flow path between the at least one second inlet opening and the outlet side. I.e. the second flow path forms a common flow path, through which the fluid flow from the first inlet as well as the fluid flow from the second inlet are led, wherein the fluid flow from the first inlet of the circulation pump assembly has already undergone a pressure increase in a first section of the first flow path upstream of the at least one second inlet opening independently of the flow from the second inlet.

Particularly preferably, the impeller comprises a plurality of second inlet openings. The flow cross section can be enlarged by way of this and the hydraulic resistance in the second flow path can therefore be minimized.

Preferably, several first flow paths are formed between impeller blades of the at least one impeller and at least one second inlet opening runs out into each of the first flow paths between the impeller blades. The sections of the first flow paths between the suction port and the second inlet openings then form the described first flow paths, through which only the fluid fed through the first inlet is delivered. The second sections of the first flow paths with the second inlet openings form a second flow path downstream of these second inlet openings, through which second flow path the fluid which is fed through the second inlet is also delivered. A maximum flow cross section for the second flow paths in the impeller is provided due to the fact that second inlet openings are arranged in each of the first flow paths.

Further preferably, the at least one second inlet opening is formed in a shroud which surrounds the suction port. I.e. the impeller is configured as a closed impeller which comprises a shroud which closes the flow paths between the impeller blades in the periphery of the centrally arranged suction port. The suction port forms the first inlet opening for the first flow paths. The second inlet openings are configured as holes or a gap in the shroud, said holes or gap running out into these flow paths between the impeller blades, so that the flow paths radially at the outer side of the second inlet openings form the second flow paths according to the preceding description.

The suction port of the at least one impeller is preferably in engagement with a stationary ring element, into the inside of which a flow connection from the first inlet runs. A flow connection from the first inlet into the inside of the impeller and into the first flow paths of the impeller is therefore created. The ring element is further preferably in an essentially sealed engagement with the suction port, i.e. a suction port seal or sealing is formed between the suction port and the ring element, in order to reduce or avoid leakages in this region.

Further preferably, an annular space, into which a flow connection from the second inlet runs out is formed at the outer periphery of the described ring element, wherein the at least one second inlet opening of the impeller faces this annular space. In this design, the ring element thus forms a separating wall between the first and the second flow connection, wherein the flow connection from the first inlet runs towards the impeller at the inner side of the ring wall and the flow connection from the second inlet towards the impeller runs at the outer side of the ring element.

According to a further preferred embodiment of the invention, the impeller radially outside the at least one second inlet opening is in sealing engagement with a part of the surrounding pump casing. This sealing engagement forms a seal between the suction side and the delivery side of the impeller, so that the outlet side of the impeller is sealed with respect to the flow connection to the at least one second inlet opening.

According to a particular embodiment of the invention, a valve can be arranged at least in the flow connection between the second inlet and the at least one impeller, for adjusting the flow rate through this flow connection. This valve can form a mixing valve, via which the fed fluid quantity from the second inlet can be regulated (closed-loop controlled), for example in to be able to regulate the temperature of the mixed flow at the outlet of the circulation pump assembly. For this, the valve can preferably comprise an electrical drive for changing the valve position, wherein the electrical drive is preferably a stepper motor. The valve can then be activated by a control device which adjusts the valve position for example in a temperature-dependent manner, in dependence on the temperature at the outlet side of the circulation pump assembly, i.e. in dependence on the temperature of the mixed flow. A mixer with a temperature regulation is therefore created. However, flow regulation valves which are to be actuated manually can also be arranged in one or both flow connections, in order for example to be able to carry out a presetting of the flow rates.

Particularly preferably, the circulation pump assembly comprises a control device which is configured for adjusting/setting the speed of the drive motor. The control device can be configured for example such that carries out a pressure regulation and/or flow rate regulation (closed-loop control), in order to maintain the pressure and/or the flow rate in the range of predefined setpoints. Alternatively, a temperature-dependent speed regulation is also possible, concerning which the speed is adjusted in dependence of a temperature signal such that a temperature value is held in the region of predefined setpoints. Thus for example the temperature at the outlet side of the circulation pump assembly, i.e. at the outlet or in the fluid flow which flows through the outlet, can be regulated by way of speed regulation or speed change of the circulation pump assembly.

Apart from the aforementioned circulation pump assembly, the subject-matter of the invention is also a heating system with such a circulation pump assembly, wherein the previously described circulation pump assembly forms a first circulation pump assembly in the heating system. The heating system according to the invention moreover comprises a second circulation pump assembly which is situated upstream of the second inlet of the first pump assembly. The second circulation pump assembly thus leads a fluid flow with a preliminary pressure which is produced by the second circulation pump assembly to the inlet of the first pump assembly. The second circulation pump assembly is preferably a circulation pump assembly which is adjustable in its speed via a control device. This centrifugal pump assembly preferably likewise comprises an electrical drive motor which further preferably can be configured as a wet-running drive motor. The preliminary pressure or flow rate can be adjusted or regulated via the speed adaptation. The speed regulation of the second circulation pump assembly is preferably effected such that the flow rate and/or the pressure is maintained in the range of desired, predefined setpoints or follows a predefined characteristic curve. The first circulation pump assembly as well as the second circulation pump assembly can be configured such that they comprise a frequency converter for speed regulation.

Further preferably, a control device is provided in the heating system according to the invention, said control device being configured in a manner such that it controls the first circulation pump assembly and/or the second circulation pump assembly and/or a valve which is situated in the flow path from the second inlet to the at least one impeller, in order to adjust a mixing ratio of the fluid flows from the first inlet and the second inlet in the first circulation pump assembly. Here, the speed control is preferably effected in a temperature-dependent manner. I.e. the control device is preferably connected to at least one temperature sensor and controls the speeds of the circulation pump assembly or of the circulation pump assemblies such that the temperature which is detected by the temperature sensor is kept to a desired setpoint or approximates a desired setpoint. The temperature sensor is preferably arranged at the outlet side of the first circulation pump assembly, so that it detects the temperature of the mixed fluid flow which flows through the outlet of the first circulation pump assembly. The quantity of the fluid which is fed to the second inlet can therefore be changed if the control device varies the speed of the second circulation pump assembly. The same can be achieved by way of adjusting a valve upstream of the second inlet of the first circulation pump assembly. It is likewise possible to change the mixing ratio by way of the speed change of the first circulation pump assembly when the flow rate ratio and/or the pressure ratio of the flows through the first and the second flow path changes in a speed-dependent manner. This can be achieved by way of a suitable geometric design of the first flow path and of the second flow path, in particular if the first and the second flow path for example end at different outer diameters of the impeller. Different pressure increases are therefore accomplished at the same speed. Changes of the pressure ratio can moreover be achieved by way of the fluid being fed to the second inlet at a preferably constant preliminary pressure. If the flow connection from the second inlet runs out into a first flow path of the impeller, as is described above, then the pressure at the run-out point in the inside of the impeller changes given a speed change, so that the mixing ratio in the inside of the impeller is changed by way of changing the pressure rations in the two flow paths.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
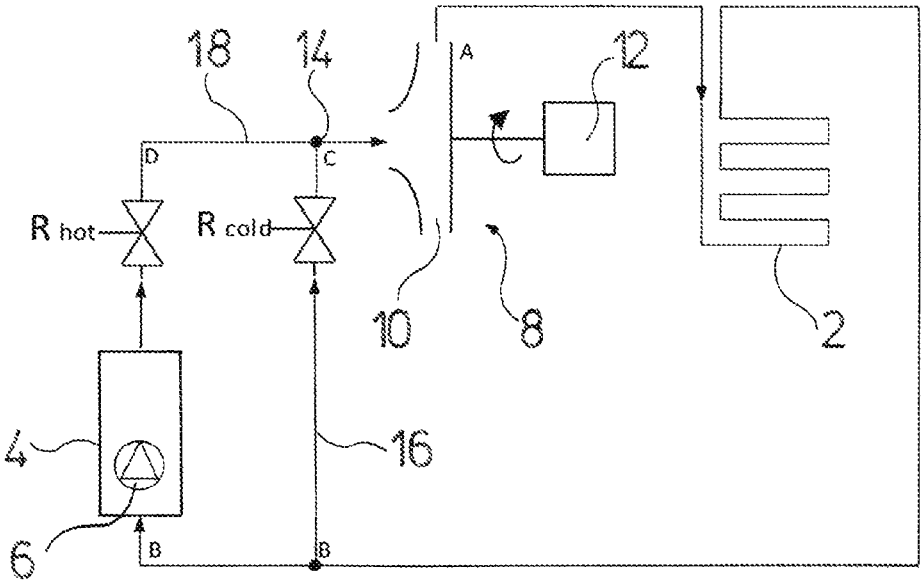
FIG. 1 is a hydraulic circuit diagram of a heating facility according to the state of the art.

Referring to the drawings, FIG. 1 schematically shows a conventional heating circuit for a floor heating 2, i.e. a heating circuit according to the state of the art. A heating boiler 4, for example a gas heating boiler with an integrated circulation pump 6 serves as a heat source. Such combinations are known on the market as compact heating facilities. A further circulation pump assembly 8 with an impeller 10 as well as with an electrical drive motor 12 is provided for the floor heating circuit 2. Here, a mixing device is provided since the heating boiler 4 has too high a feed temperature for the floor heating 2, wherein this mixing device has a mixing point 14 which is situated at the suction side of the impeller 10. A return conduit 16 of the floor heating circuit 2 runs out at the mixing point 14. A feed conduit 18, via which the water or heating medium which is heated by the boiler 4 is fed and injected at the mixing point 12 by the pressure produced by the circulation pump assembly 6 runs out at the mixing point or run-out point 14. In this example, two flow regulation valves $R_{hot}$ and $R_{cold}$ are provided for regulating the mixing ratio. The regulating valve $R_{hot}$ is arranged in the feed conduit 18 and the regulating valve $R_{cold}$ in the return conduit 16. The valves can be activated for example by a control device via an electrical drive. The regulating valves $R_{hot}$ and $R_{cold}$ can preferably be coupled such that one of the valves is always opened and the other valve is simultaneously closed by the same amount, for changing the flow rate. A 3-way valve which comprises a valve element which by way of its movement simultaneously closes the return conduit 16 and opens the feed conduit 18 or vice versa can also be used instead of two flow regulation valves R. The circulation pump assembly 6 can moreover supply a further heating circuit which is not shown here and which is operated directly with the feed temperature produced by the heating boiler. The circulation pump assembly 6 as well as the circulation pump assembly 8 can have a conventional pressure regulation or flow-rate regulation. Concerning the known system, it is a disadvantage that the flow regulation valves R are necessary for adjusting the mixing ratio and need to be provided with a suitable drive, for example with a motorically or thermostatically actuated drive. The flow regulation valves R are regulated such that a desired feed temperature for the flow heating 2 is reached downstream of the mixing point 14. A further disadvantage in this system is the fact that the pressure which is produced by the circulation pump assembly 6 needs to be reduced via the flow regulation valve $R_{hot}$, in order to achieve the suction-side pressure of the impeller 10 at the mixing point 14. An energy loss thus occurs in the system, and this loss can be avoided with the solution according to the invention which is described hereinafter.

Figure 2:
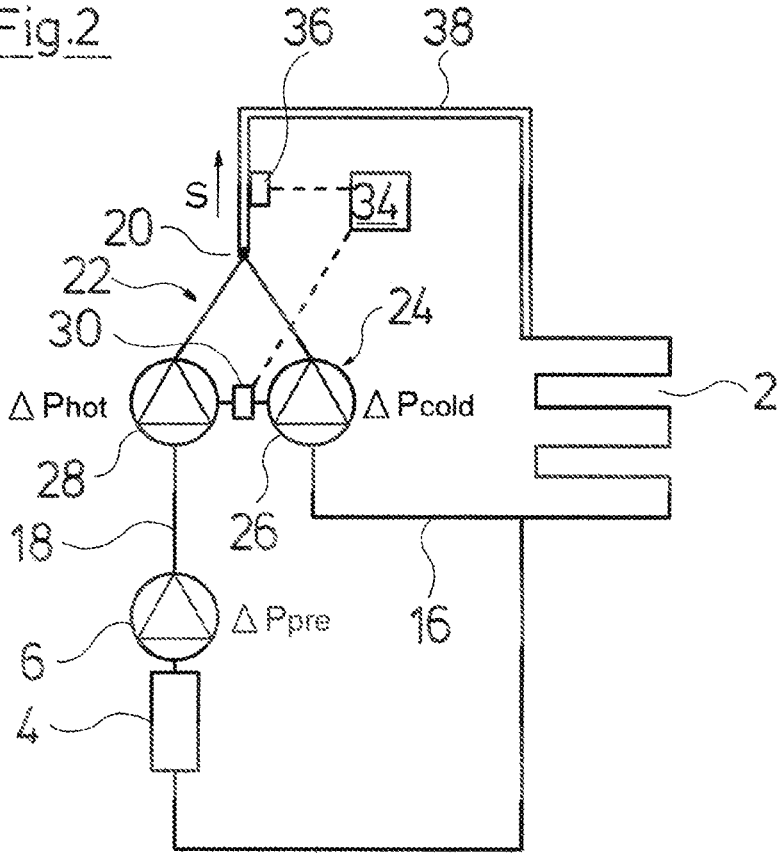
FIG. 2 is a hydraulic circuit diagram of a heating system according to a first embodiment of the invention.
Figure 3:
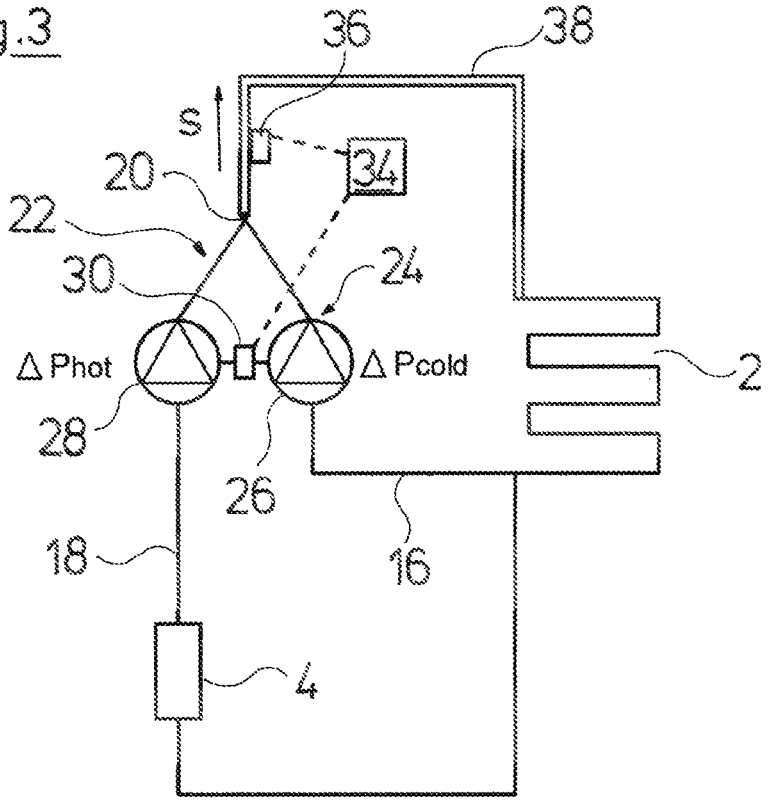
FIG. 3 is a hydraulic circuit diagram of a heating facility according to a second embodiment of the invention.
Figure 4:
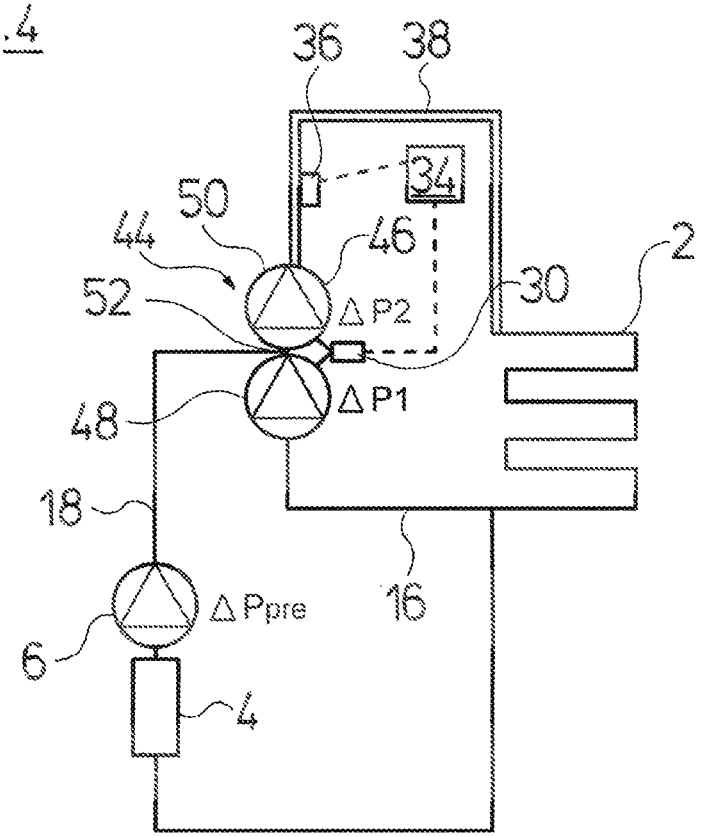
FIG. 4 is a hydraulic circuit diagram of a heating system according to a third embodiment of the invention.

Concerning the three solutions according to the invention which are described by way of example and are schematically represented in FIGS. 2 to 4, the mixing ratio for achieving a desired feed temperature for the floor heating 2 is achieved solely by way of a speed regulation of a circulation pump assembly. This assembly comprises two flow paths which mutually hydraulically influence one another such that the hydraulic resistance in at least one of the flow paths can be changed by way of a speed change, in order to change the mixing ratio as is described hereinafter.

FIG. 2 shows a first embodiment example of the invention. In this, again a heating boiler 4 is provided for heating a fluid heating medium, i.e. a fluid heat-transfer medium such as water. A circulation pump assembly 6 is moreover arranged on this boiler 4 and could also be integrated into the heating boiler 4, as has been explained regarding FIG. 1. The circulation pump assembly 6 delivers heat transfer medium in a feed conduit 18. A floor heating 2 or a floor heating circuit 2 is moreover provided and this comprises a return which on the one hand is connected to the inlet side of the heating boiler 4 and on the other hand leads via a return conduit 16 to a mixing point 20, at which the feed conduit 18 also runs out. The mixing point or run-out point 20 is part of a mixing device 22 and moreover of a circulation pump assembly 24. The mixing device 22 and the circulation pump assembly 24 can form an integrated construction unit, so that the mixing device 22 is part of the circulation pump assembly 24 or the circulation pump assembly 24 is part of the mixing device. In particular, the mixing point 20 can lie directly in the pump casing or in an impeller of the circulation pump assembly 24, as is described hereinafter.

In the embodiment example according to FIG. 2, the circulation pump assembly 24 is configured as a double pump with two impellers 26 and 28. The impellers 26 and 28 are driven via a common drive motor 30. The impellers 26 and 28 can be configured as separate impellers or as an integrated impeller with two blade arrangements or flow paths. The first impeller 26 forms a first flow path and lies in a first flow connection in the mixing device from the return conduit 16 to the mixing point 20. The second impeller 28 forms a second flow path and lies in a second flow connection between the feed conduit 18 and the mixing point 20. The mixing point 20 therefore lies at the delivery side of the two impellers 26 and 28, i.e. according to the invention, the two heating medium flows are mixed with one another after a pressure increase.

The drive motor 30 is controlled or regulated by a control device 34 which serves for speed regulation or speed control of the drive motor 30 and is configured such that it can change the speed of the drive motor 30. For this, the control device 34 comprises a speed controller, in particular amid the application of a frequency converter. The control device 34 can be integrated directly into the drive motor 30 or be arranged in an electronics casing directly on the drive motor and in particular on the motor casing of this motor. The control device 34 is moreover connected to a temperature sensor 36 or communicates with a temperature sensor 36. The temperature sensor 36 is situated downstream of the mixing point 20 on or in the feed conduit 38 which connects the mixing point 20 to the floor heating circuit 2. Here, the temperature sensor 36 can be integrated into the mixing device 22 or into the circulation pump assembly 24. The connection of the temperatures sensor 36 to the control device 34 can be provided in an arbitrary manner, for example connected by wire or also in a wireless manner. A wireless connection can be realized for example via a radio connection such as Bluetooth or W-LAN.

The temperature sensor 36 transmits a temperature value of the heating medium downstream of the mixing point 20 to the control device 34, so that this can carry out a temperature regulation. According to the invention, the drive motor 30 and therefore the circulation pump assembly 34 is not regulated in a pressure-dependent or flow-rate-dependent manner, but in a temperature-dependent manner. I.e. the control device 34 adapts the speed of the drive motor 30 such that a desired temperature of the heating medium is reached downstream of the mixing point 20. The desired temperature is defined by a temperature setpoint which can be set in a fixed manner, can be manually adjusted or can be specified depending on the outer temperature by a heating curve which is stored in the control device 34 or a superordinate control. The control device 34 varies the speed of the drive motor 30, by which means, as described hereinafter, the mixing ratio of the heating medium flows which are mixed at the mixing point 20 changes, so that the temperature downstream of the mixing point 20 changes. This temperature is detected by the temperature senor 36, so that the control device 34 can carry out a temperature regulation by way of speed variation of the drive motor 30, in order for the temperature value downstream of the mixing point 20 to approximate the temperature setpoint.

Figure 13:
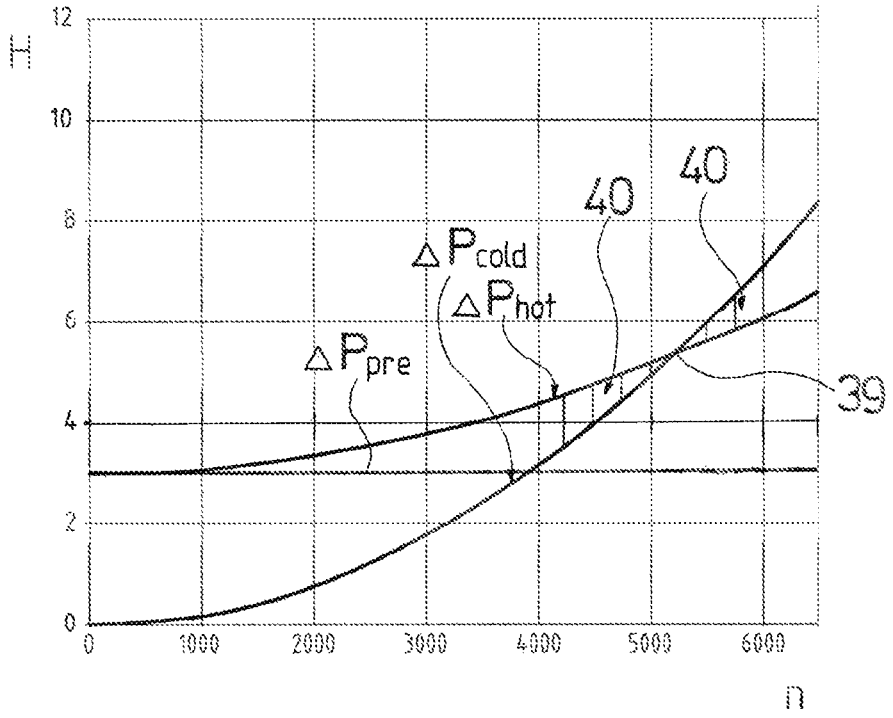
FIG. 13 is a graph of the pressure course over the speed for the embodiment example of a heating system according to FIG. 2.

The variation of the mixing ratio at the mixing point 20 via the speed change is explained in more detail by way of FIG. 13. In FIG. 13, the delivery head H, i.e. the pressure is plotted against the speed n of the drive motor 30. In the example which is shown in FIG. 2, there are three differential pressure values $\Delta P_{pre}$, $\Delta P_{hot}$ and $\Delta P_{cold}$. The differential pressure $\Delta P_{pre}$ is produced by the circulation pump assembly 6 and in this case cannot be influenced by the mixing device 22, so that it is represented in FIG. 13 as a constant preliminary pressure, i.e. one which is independent of the speed of the drive motor 30. The impeller 26 of the circulation pump assembly 24 produces a differential pressure $\Delta P_{cold}$ for the return of the floor heating 2 and the impeller 28 produces a differential pressure $\Delta P_{hot}$ for the feed from the feed conduit 18. As is to be recognized in FIG. 13, the impellers 26 and 28 are configured differently, so that they have different pressure courses, i.e. different speed-dependent pressure courses. The pressure course for the impeller 28 is less steep than the pressure course of the impeller 26. This can be achieved for example by way of the impeller 26 having a larger outer diameter. The differential pressures $\Delta P_{pre}$ and $\Delta P_{hot}$ moreover sum for the heated heating medium which is fed through the feed conduit 18, so that the curve of the pressure course $\Delta P_{hot}$ is shifted to the top in the diagram by a constant value. One succeeds in the pressure course curves $\Delta P_{hot}$ and $\Delta P_{cold}$ intersecting at a point 39 by way of this. Mixing regions 40 for the mixed fluid result above and below the intersection point of these curves. Given a speed n below the intersection point 39 of the two pressure course curves, the outlet pressure of the impeller 28 is higher than that of the impeller 26, so that the outlet pressure of the impeller 28 in the flow path through the impeller 26 acts at the mixing point 20 as a counter-pressure and a hydraulic resistance and in this operating condition the flow rate through the first flow path through the impeller 26 is reduced and more heated heating medium is admixed, in order to reach a higher temperature in the feed 38 to the floor heating circuit 2. If the speed is increased, then the outlet pressure of the impeller 26 is greater than that of the impeller 28 above the intersection point 39 of the two pressure course curves, so that a hydraulic resistance in the form of a counter-pressure is produced at the mixing point 20 in the second flow path through the impeller 28 and the flow rate through the second flow path is reduced, by which means less heated heating medium is fed at the mixing point 20 and the temperature at the outlet side of the mixing point 20 can be reduced.

Figure 14:
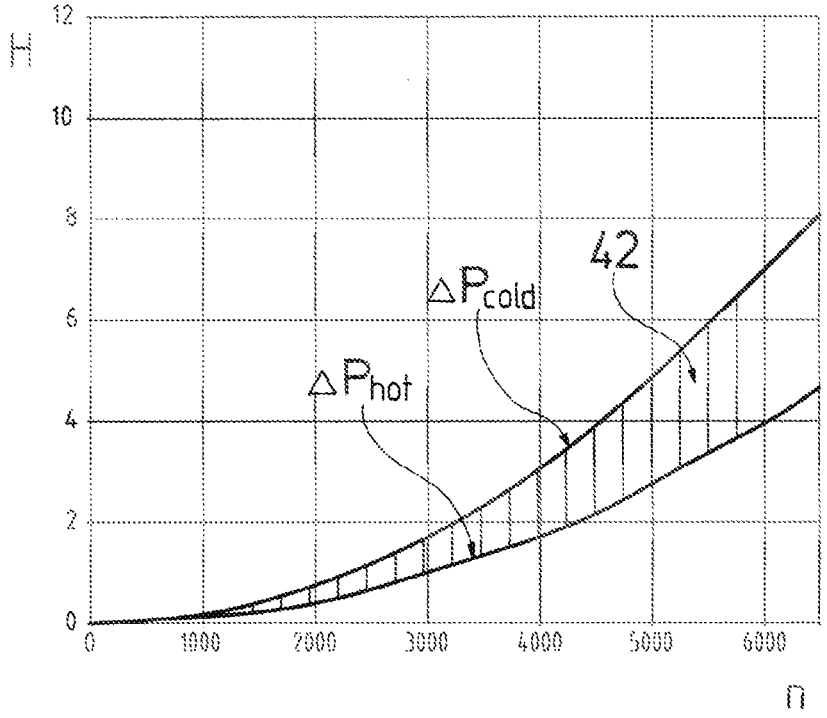
FIG. 14 is a graph of the pressure course over the speed for an embodiment example of a heating system according to FIG. 3.

FIG. 3 shows a further variant of a mixing device according to the invention or of a heating system according to the invention, which differs from the heating system according to FIG. 2 in that no circulation pump assembly 6 is provided in the feed 18. I.e. the heated heating medium is fed to the circulation pump assembly 24 via the feed conduit 18 without a preliminary pressure. The curves of the pressure course which are shown in FIG. 14 result on account of this. Again, in FIG. 14 the delivery head H, i.e. the pressure is plotted against the speed n of the drive motor 30. The pressure course curves $\Delta P_{cold}$ and $\Delta P_{hot}$ correspond to the pressure course curves which are shown in FIG. 13. It is only the constant preliminary pressure $\Delta P_{pre}$ which is absent, so that the pressure course curve $\Delta P_{hot}$ is not shifted upwards in the diagram, but begins at the origin just as the pressure course curve $\Delta P_{cold}$. However, both curves have a different gradient which again, as described above, is achieved by a different impeller diameter of the impellers 26 and 28. The hydraulic resistances change due to the fact that the differential pressure at the impellers 26 and 28 changes to a different extent given a change in speed, by which means a mixing region 42 results between the two pressure course curves with a resulting differential pressure. The higher outlet pressure $\Delta P_{cold}$ of the impeller 26 acts as a hydraulic resistance in the second flow path through the impeller 28 at the mixing point 20. The hydraulic resistance results from the pressure difference between the outlet pressures of the impellers 26 and 28 at the mixing point 20. As can be recognized in FIG. 14, this pressure difference between the pressure course curves $\Delta P_{cold}$ and $\Delta P_{hot}$ (the mixing region 42) is speed-dependent. I.e. the hydraulic resistance which acts in the flow path through the impeller 28 can thus also be varied by way of speed change, so that the flow rate through the impeller 28 and thus the flow rate of heated heating medium can be changed. A change of the temperature at the outlet side of the mixing point 20 and, with this, a temperature regulation is therefore also possible by way of a speed change of the speed n of the drive motor 30.

Figure 5:
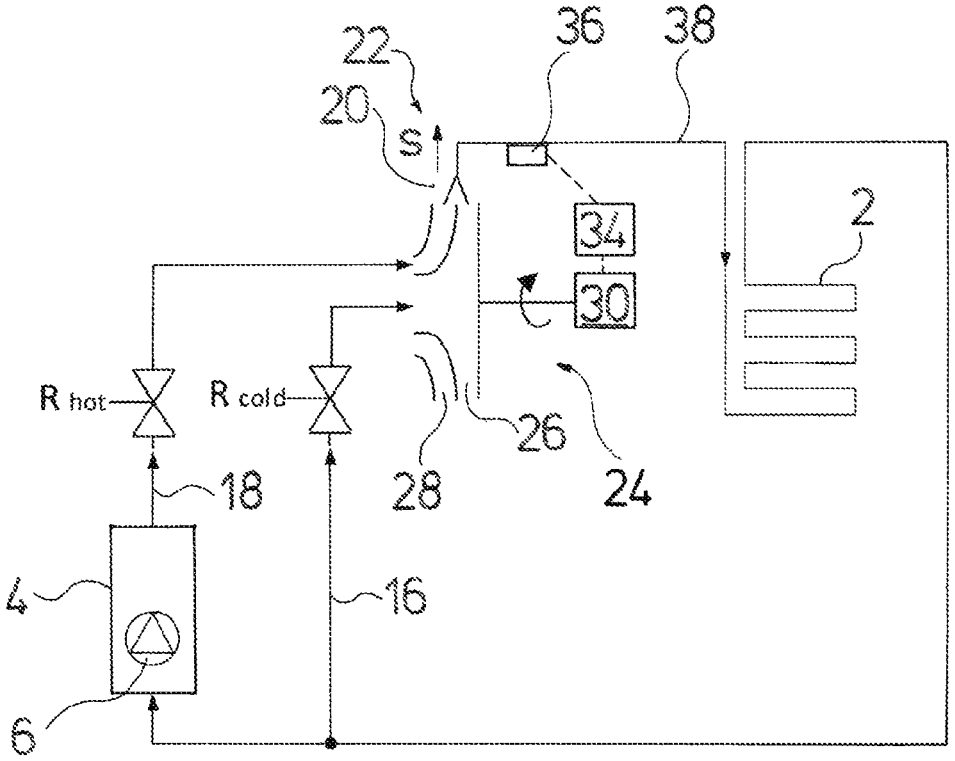
FIG. 5 is a hydraulic circuit diagram of a heating facility according to the embodiment example according to FIG. 3, with a double impeller.
Figure 6:
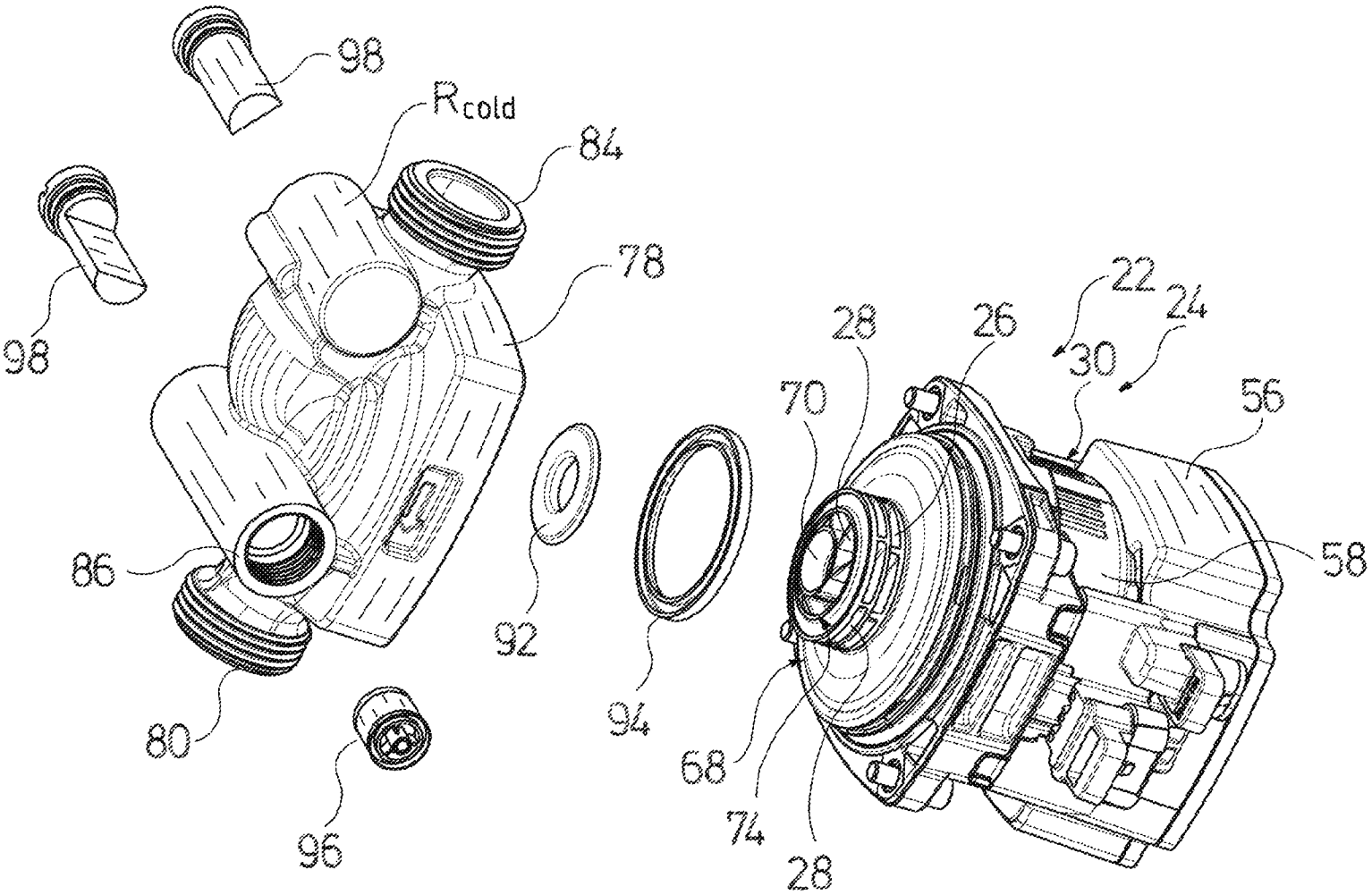
FIG. 6 is an exploded view of a circulation pump assembly with a mixing device according to the heating system according to FIGS. 2, 3, and 5.
Figure 7:
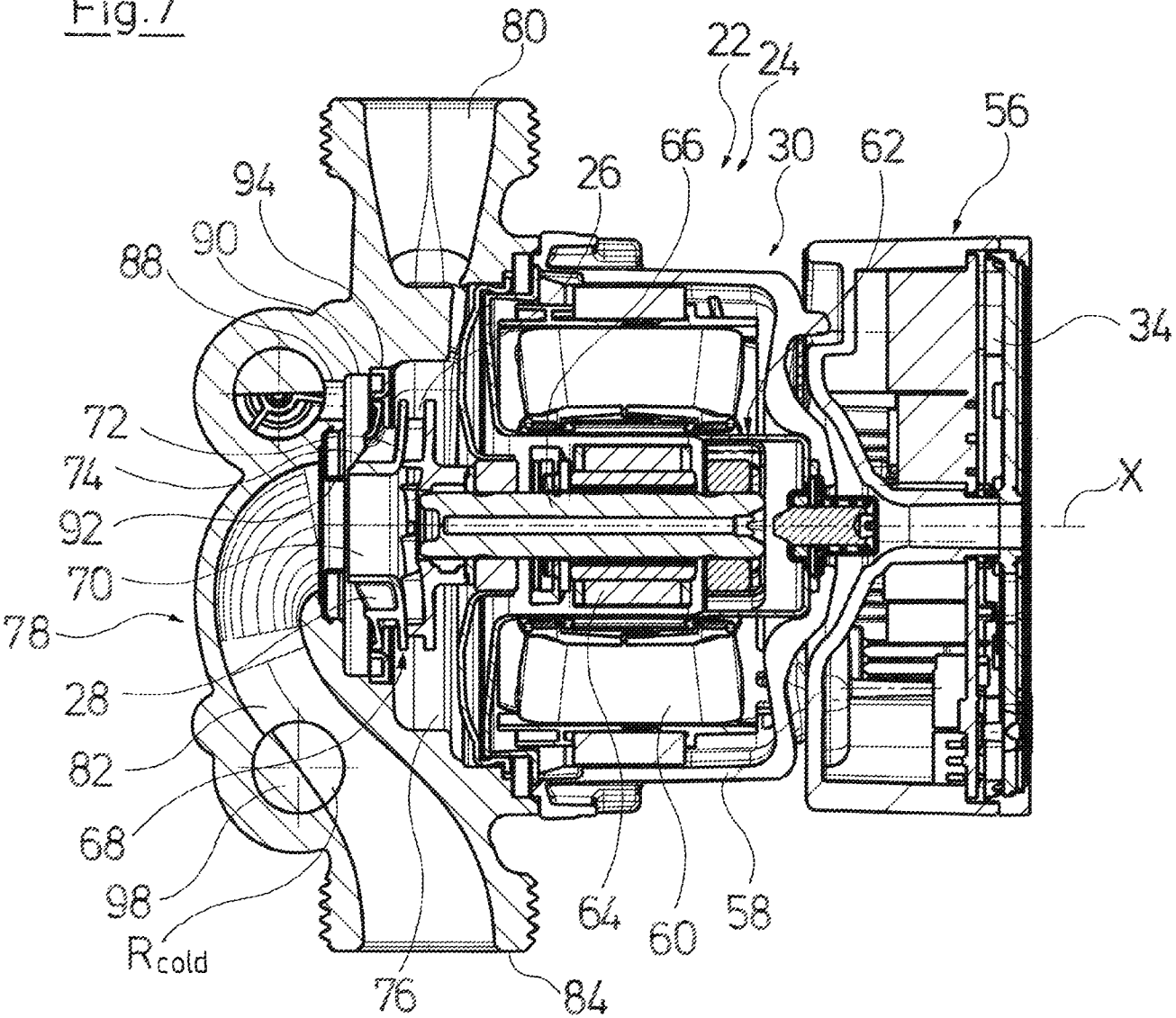
FIG. 7 is a sectioned view of the circulation pump assembly according to FIG. 6 along its longitudinal axis X.
Figure 8:
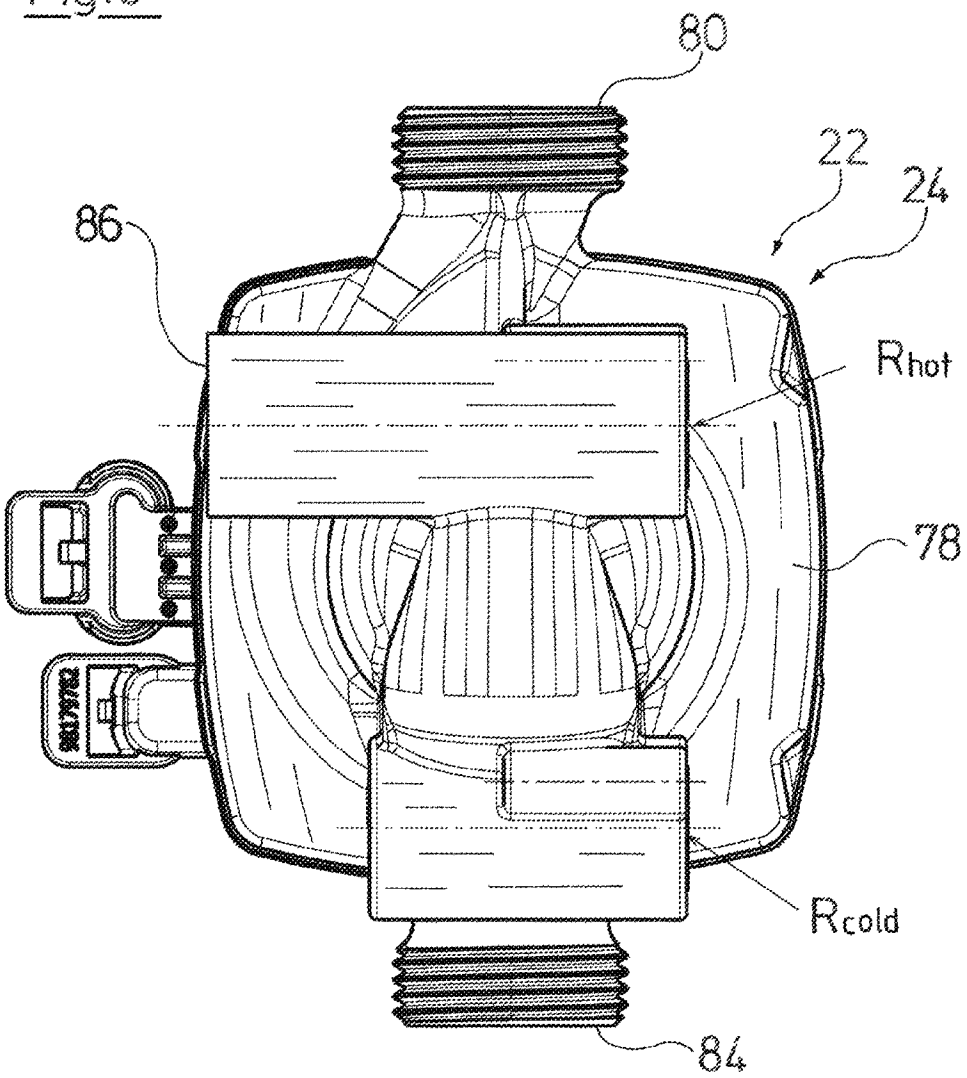
FIG. 8 is a plan view of the rear side of the circulation pump assembly according to FIGS. 6 and 7.
Figure 9:
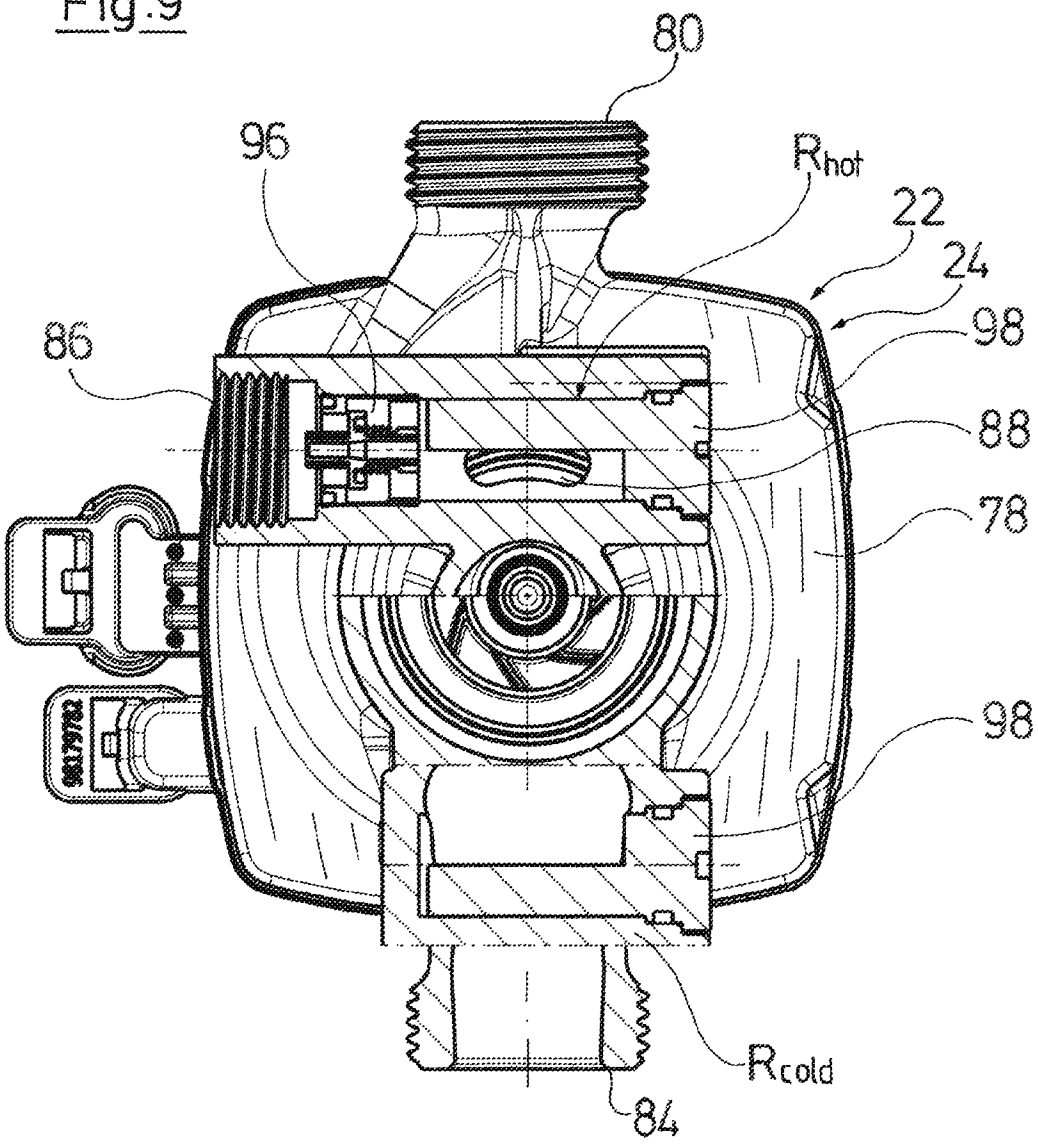
FIG. 9 is a partly sectioned view of the rear side of the circulation pump assembly according to FIGS. 6 to 8.

FIG. 5 shows an embodiment example which represents one variant of the embodiment example which is shown in FIG. 2. The two impellers 26 and 28 are configured in the form of a double impeller. I.e. the impeller 26 is formed by a first blade ring and the impeller 28 by a second blade ring of the same impeller. The variation of the mixing ratio at the mixing point 20 via a change of the speed n of the drive motor 30 is effected in the same manner as described by way of FIGS. 3 and 13. In this embodiment example, a flow regulation valve $R_{hot}$ is additionally provided in the feed conduit 18 and as well as a flow regulation valve $R_{cold}$ in the return conduit 16, upstream of the impellers 26 and 28. These are manually adjustable valves, with which a presetting can be carried out before the described speed regulation control is carried out. The presetting is preferably effected in a manner such that the speed of the drive motor 30 is firstly set such that an adequate flow rate through the floor circuit 2 is achieved. I.e. the speed of the impellers 26 and 28 is firstly set such that a differential pressure which is matched to the facility, i.e. to the hydraulic resistance of the facility, is produced. The manual flow regulation valves $R_{hot}$ and $R_{cold}$ are subsequently adjusted or set such that a desired temperature setpoint is reached at the temperature sensor 36 at the given speed. This temperature setpoint for example can be a temperature setpoint which is set by a heating curve given the current outer temperature. A compensation between the different hydraulic resistances in the feed conduit 18 and the return conduit 16 is achieved by the manual presetting. After this presetting, the temperature regulation can then be carried out by way of speed regulation with the help of the control device 34, wherein only slight speed changes are necessary for temperature adaptation, as results from the diagram in FIG. 13. Such valves for presetting can also be used with the other described embodiments examples.

FIG. 4 shows a third variant of a heating system with a mixing device according to the invention. A heating boiler 4 with a circulation pump assembly 6 which is arranged downstream is also provided in this heating system. A floor heating 2 or a floor heating circuit 2 which is to be supplied is also provided. Here too, a mixing device 44 is present, in which mixing device a heating medium flow from a feed 18 which extends in a manner departing from the heating boiler 4 is mixed with a heating medium flow from a return conduit 16 from the return of the floor heating 2. In this embodiment example, the mixing device 44 again comprises a circulation pump assembly 46 with an electrical drive motor 30. This drive motor 30 is also regulated in its speed by the control device 34 which can be integrated directly into the drive motor 30 or in an electronics casing directly on the drive motor 30. As with the preceding embodiment examples, the control device 34 is communicatingly connected to a temperature sensor 36 which is situated on a feed conduit 38 to the floor heating circuit 2, so that it detects the feed temperature of the heating medium which is fed to the floor heating circuit 2. A temperature-dependent speed control can therefore also be carried out with regard to the circulation pump assembly 36 in the manner described above.

The embodiment example according to FIG. 4 differs from the previously described embodiment examples in that the circulation pump assembly although comprising no impellers arranged in parallel however comprises impeller parts 48 and 50 which are arranged in series. The impeller parts 48 and 50 can be configured as two separate impellers which are connected to one another in a rotationally fixed manner, so that these are rotatingly driven via the common drive motor 30. Particularly preferably, the impeller parts 48, 50 are however configured as an impeller which between a first central inlet opening and the outlet opening comprises at least one second inlet openings in a radially middle region, as described in more detail below. Concerning this embodiment example, this second inlet opening forms the mixing point or run-out point 52, at which the two flow fluid flows or heating medium flows from the return conduit 16 and the feed conduit 18 are mixed. The heating medium flow from the return conduit 16 undergoes a first pressure increase $\Delta P_1$ upstream of the mixing point 52 via the impeller part 48. The heating medium flow from the feed conduit 18 undergoes a pressure increase $\Delta P_{pre}$ by way of the circulation pump assembly 6. At the run-out point 52, the heating medium flow is injected at this preliminary pressure into the heating medium flow which leaves the impeller part 48. The run-out point 52 and the second impeller part 50 form a second flow path. The heating medium flow from the feed conduit 18 and, in the further course downstream of the run-out point 52, also the heating medium flow which is from the return conduit 16 and which has previously undergone a pressure increase in a first flow path in the impeller part 48, flow through this second flow path. The mixed heating medium flow undergoes a further pressure increase $\Delta P_2$ in the impeller part 50.

Figure 15:
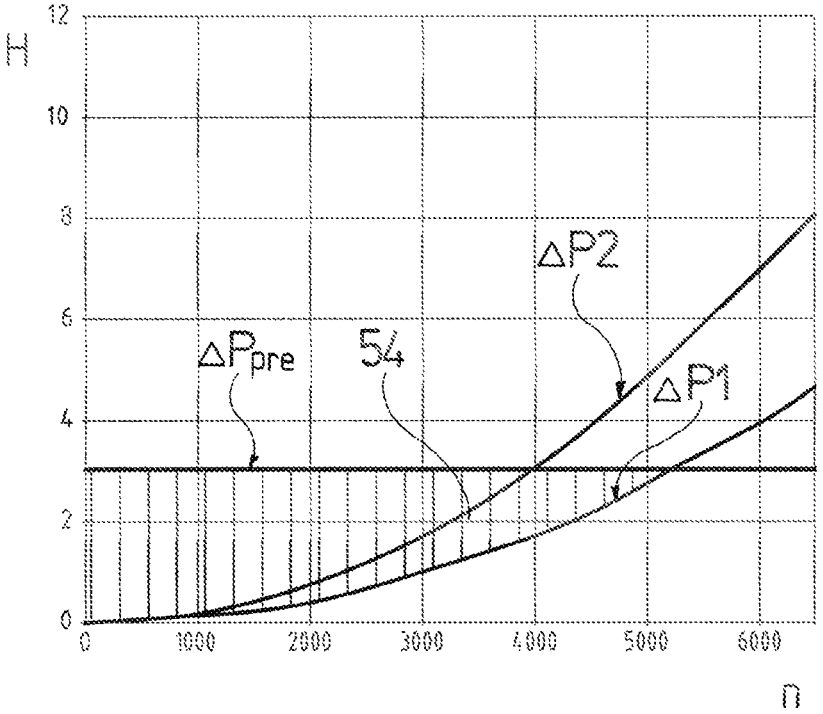
FIG. 15 is a graph of the pressure course over the speed for an embodiment example of a heating system according to FIG. 4.

With this configuration too, the mixing ratio between the heating medium flow from the return conduit 16 and the heating medium flow from the feed conduit 18 can be changed by way of a speed change, as is described in more detail by way of FIG. 15. In FIG. 15, the pressure courses in the form of the delivery head H are again plotted against the speed n of the drive motor 30. The constant preliminary pressure $\Delta P_{pre}$ which is produced by the circulation pump assembly 6 is to be recognized as a horizontal line in the diagram in FIG. 15. Moreover, the two speed-dependent pressure courses $\Delta P_1$ and $\Delta P_2$ are again shown. Here, the pressure course $\Delta P_2$ has a steeper course than the pressure course $\Delta P_1$, i.e. given an increase of the speed, the pressure $\Delta P_2$ rises more rapidly than the pressure $\Delta P_1$. A mixing region 54, in which different mixing ratios can be realized is located between the pressure course $\Delta P_1$ and the preliminary pressure $\Delta P_{pre}$. The hydraulic resistance in the second flow path to the impeller part 50 increases at the mixing point 52 with an increasing pressure $\Delta P_1$ which the heating medium flow from the return conduit 16 undergoes in the impeller part 48. A counter-pressure forms at the mixing point 52 and this counter-pressure serves as a hydraulic resistance for the heating medium flow which enters into the mixing point 52 from the feed conduit 18. The higher the counter-pressure at the mixing point 52, the lower becomes the flow rate through this second flow path through the run-out point 52, i.e. the smaller does the heating medium flow which enters from the feed conduit 18 into the mixing point 52 and thus into the second flow path become. The warm water flow, i.e. the heating medium flow from the feed conduit 18 is completely disconnected when the preliminary pressure $\Delta P_{pre}$ is exceeded by the pressure $\Delta P_1$. The mixing ratio can therefore be changed by way of speed change. The mixed heating medium flow then undergoes the pressure increase to the pressure $\Delta P_2$ in the second impeller part 50.

This arrangement has the advantage that the pressure $\Delta P_{pre}$ which is produced by the circulation pump assembly 6 does not have to be reduced, since the mixing of the two heating medium flows takes place at a greater pressure level, specifically at the level of the pressure $\Delta P_1$. Energy losses in the mixing device 44 are reduced by way of this.

Figure 10:
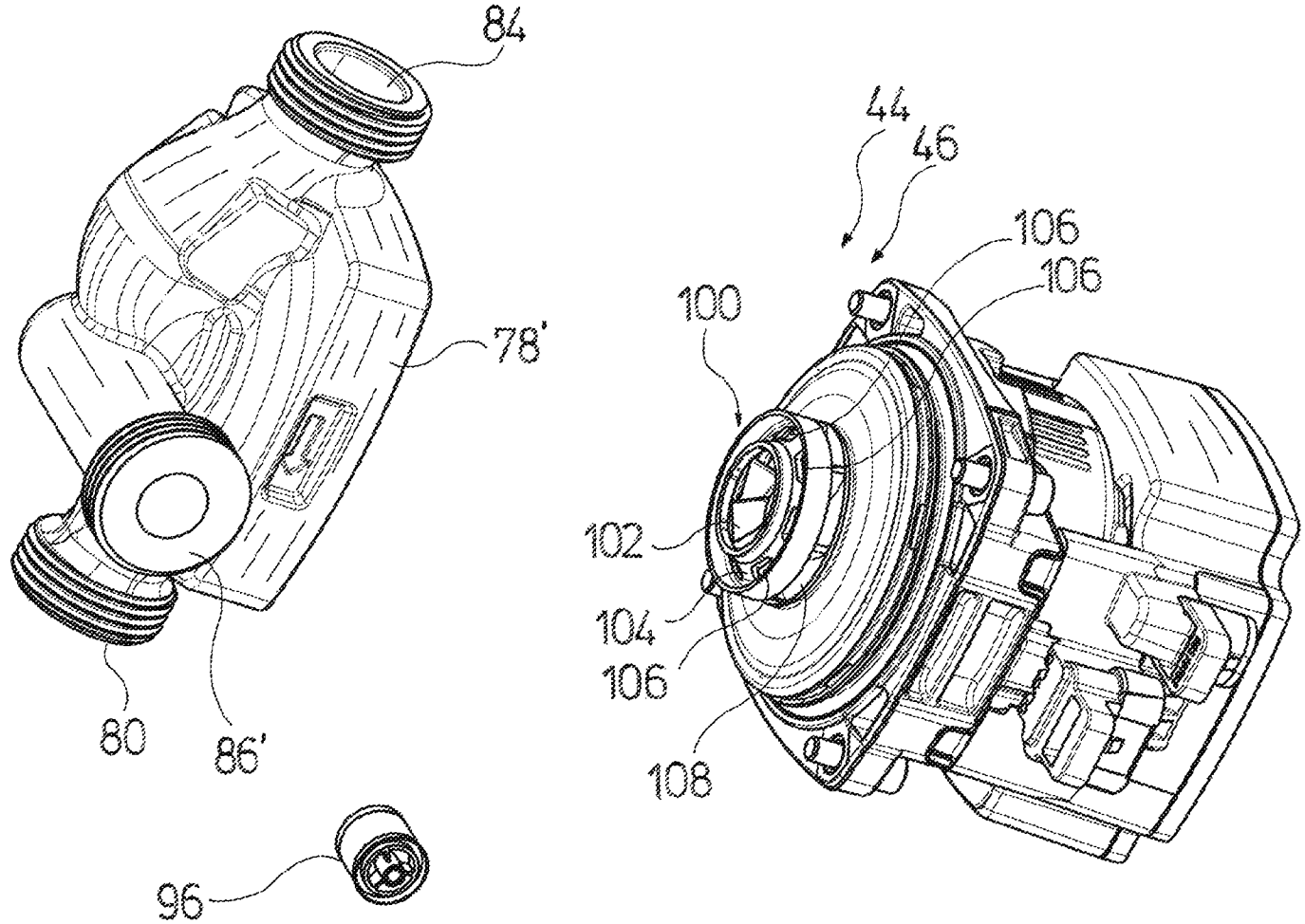
FIG. 10 is an exploded view of a circulation pump assembly with a mixing device according to the embodiment example according to FIG. 4.
Figure 11:
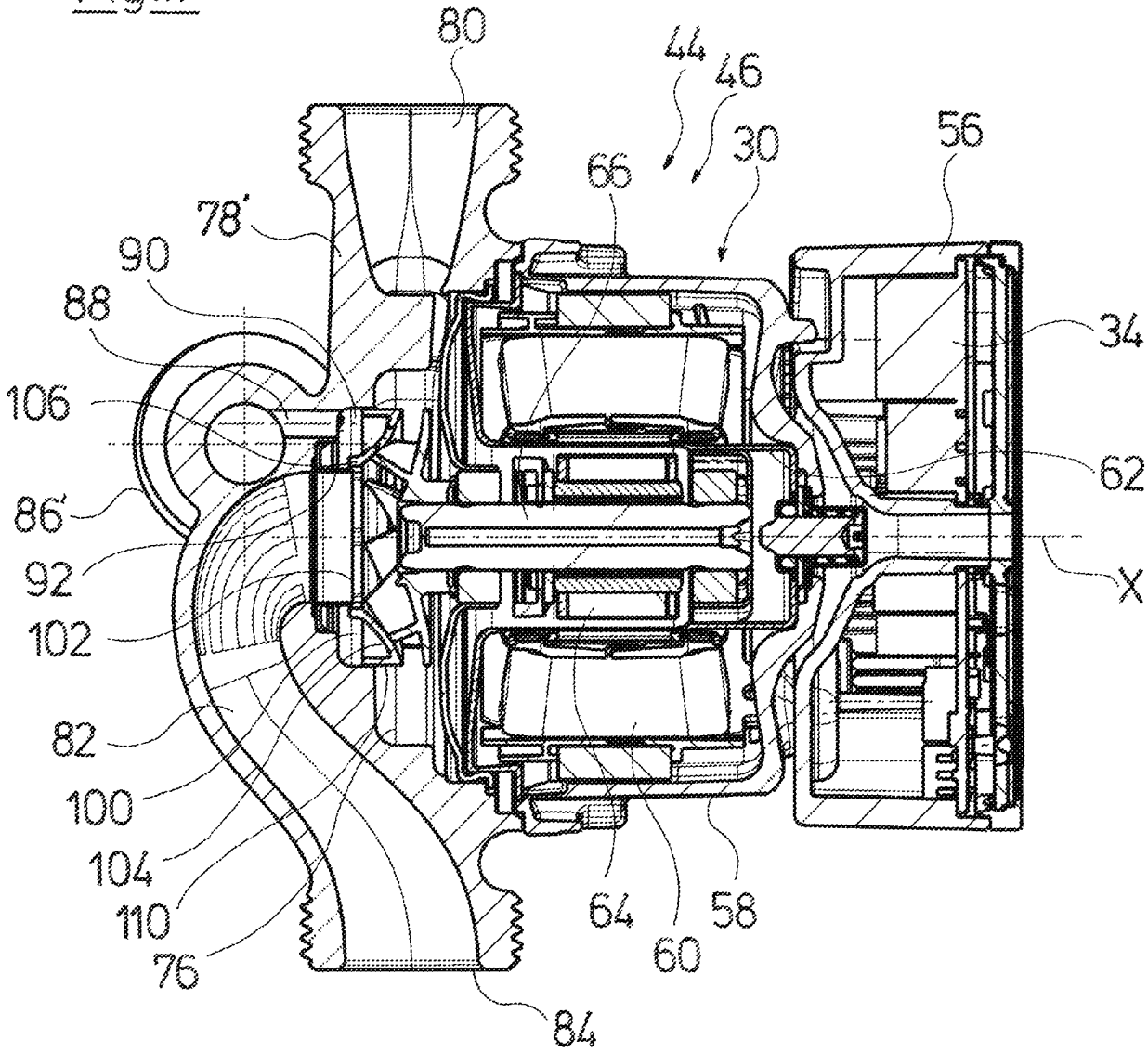
FIG. 11 is a sectioned view of the circulation pump assembly according to FIG. 10, along its longitudinal axis X.
Figure 12:
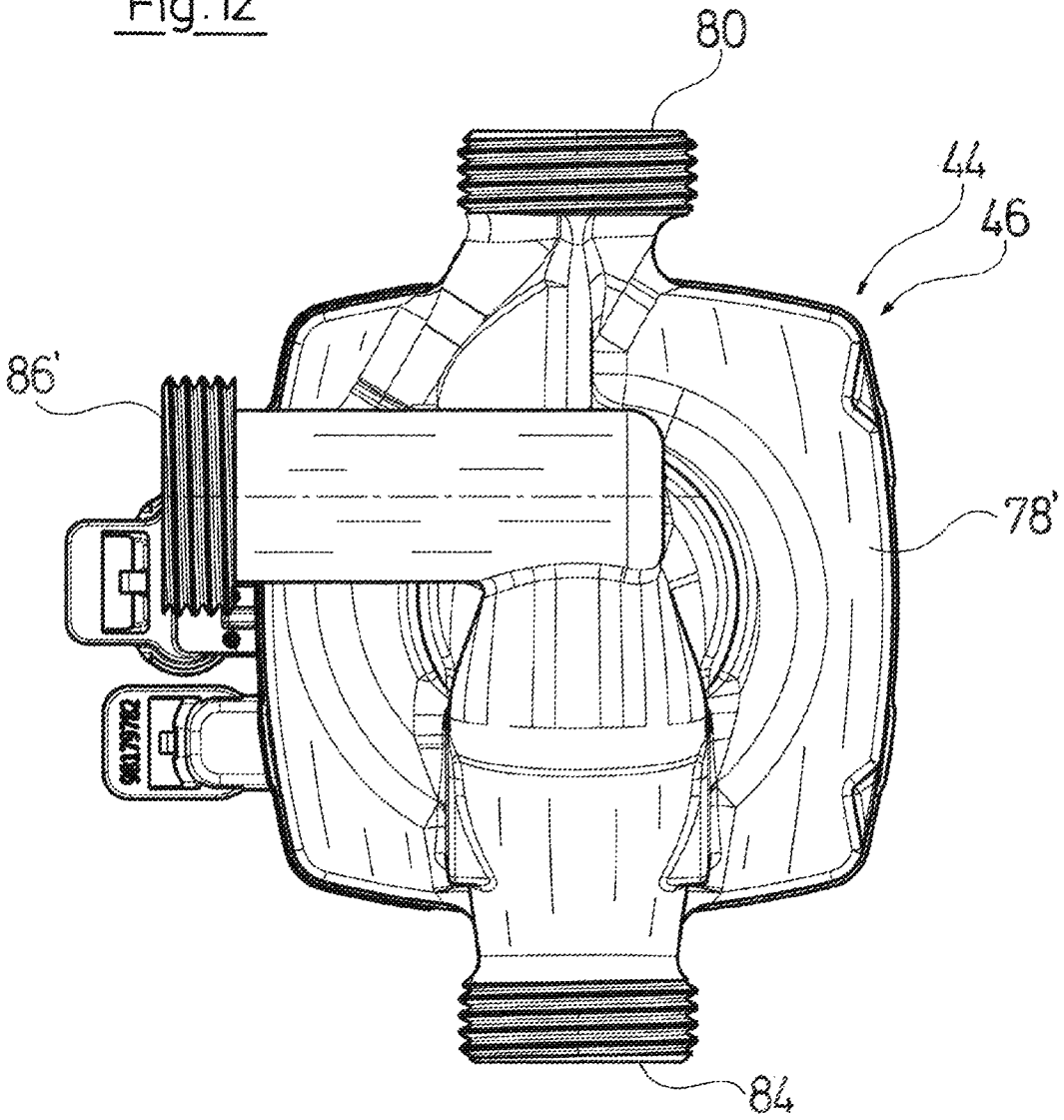
FIG. 12 is a plan view of the rear side of the circulation pump assembly according to FIGS. 9 and 10.

The design construction of the mixing devices 22 and 44 are hereinafter described in more detail by way of the FIGS. 6 to 12. Here, FIGS. 6 to 9 show a mixing device which is used as a mixing device 22 in the embodiment examples according to FIGS. 2, 3 and 5. FIGS. 10 to 12 show a mixing device 44 as is applied with the embodiment example according to FIG. 4.

The embodiment example according to FIGS. 6 to 9 shows an integrated circulation pump mixing device, i.e. a circulation pump assembly with an integrated mixing device or a mixing device with an integrated circulation pump assembly. The circulation pump assembly in the known manner comprises an electrical drive motor 30, on which an electronics casing or terminal box 56 is attached. In this embodiment example, the control device 34 is arranged in the electronics casing. The electrical drive motor comprises a stator or motor casing 58, in whose interior the stator 60 of the drive motor 30 is arranged. The stator 60 surround a can pot or can 62 which separates the stator space from a centrally situated rotor space. The rotor 64 which can be configured for example as a permanent magnet rotor is arranged in the rotor space. The rotor 64 is connected to the impeller 68 via a rotor shaft 66, so that the rotor 64, given its rotation about the rotation axis X, rotatingly drives the impeller 68.

In this embodiment example, the impeller 68 is configured as a double impeller and unifies the impellers 26 and 28, as has been described by way of FIGS. 2 and 5. The impeller 68 comprises a central suction port 70 which runs out into a first blade arrangement or into a first blade ring which forms the impeller 26. A first flow path through the impeller 68 is therefore defined by the suction port 70 and the impeller 26. The impeller 26 is configured in a closed manner and comprises a front shroud 72 which merges into a collar which delimits the suction port 70. A second blade ring which forms the second impeller 28 is arranged or formed on the front shroud 72. The second impeller 28 at the inlet side comprises an annular suction port 74 which annularly surrounds the suction port 70. The second suction port 74 forms a second inlet opening of the impeller 68. Departing from the second suction port 74, the impeller 28 forms a second flow path through the impeller 68. The impeller 26 as well as the impeller 28 comprises outlet openings at the peripheral side, said outlet openings running out into a delivery chamber 76 of a pump casing 78.

The pump casing 78 is connected to the motor casing 58 in the usual manner. The delivery chamber 76 in the inside of the pump casing 78 runs out into delivery pipe connection 80, onto which the feed conduit 38 to the floor heating circuit 2 would connect in the embodiment examples according to FIGS. 2, 3 and 5. Since both impellers 26 and 28 run out into the delivery chamber 76, the mixing point 20 which is described by way of FIGS. 2, 3 and 5 lies at the outlet side of the impeller 68 in the delivery chamber 76 of the pump casing 78.

The first suction port 70 of the impeller 68, in the pump casing 78 is in connection with a first suction conduit 82 which begins at a first suction pipe connection 84. This first suction pipe connection 84 lies in a manner in which it is axially aligned to the delivery pipe connection 80 along an installation axis which extends normally to the rotation axis X. In the embodiment examples according to FIGS. 2, 3, and 5, the return conduit 16 is connected to the suction pipe connection 84. In this embodiment example, a flow regulation valve $R_{cold}$ as is shown in FIG. 5 is moreover arranged in the suction conduit 82.

A first flow connection through the pump casing 78 is defined from the suction pipe connection 84 which forms a first inlet, via the suction conduit 82, the suction port 70, the first impeller 26, the delivery chamber 76 and the delivery pipe connection 80. The pump casing 78 moreover comprises a second suction pipe connection 86 which forms a second inlet. In the inside of the pump casing 78, the second suction pipe connection is connected to an annular space 90 at the suction side of the impeller 68 via a connection channel 88. The annular space 90 surrounds a ring element 92 at the outer periphery. The ring element 92 is inserted into the suction chamber of the pump casing 78 and with its annular collar is in engagement with the collar which surrounds the suction port 70, so that a sealed flow connection is created from the suction channel 82 into the suction port 70. The ring element 92 is surrounded by the annular space 90 at the outer periphery, so that the ring element 92 separates the flow path to the suction port 70 from the flow path to the second suction port 74. An annular sealing element 94 which bears on the inner periphery of the pump casing 78 and comes into sealing bearing contact with the outer periphery of the impeller 68 is inserted into the pump casing. Here, the sealing element 94 is in sealing bearing contact with the impeller 68 in the outer peripheral region of the second suction port 74, so that in the pump casing it separates the suction region from the delivery chamber 76 at the inlet side of the suction port 74.

A check valve 96 which prevents a backflow of fluid into the feed conduit 18 is moreover arranged in the flow path from the second suction pipe connection 86 to the connection channel 88. The feed conduit 18, as is shown in FIGS. 2, 3 and 5, is connected onto the second suction pipe connection 86.

A temperature adjustment of the heating medium which is fed to the floor heating circuit 2 can be achieved with the shown circulation pump assembly 24 with the integrated mixing device 22 by way of a speed change of the drive motor 30, as was described by way of FIGS. 2, 3 and 5 as well as 13 and 14.

A presetting can be carried out via the flow regulation valves $R_{cold}$ and $R_{hot}$, as described by way of FIG. 5. In this embodiment example, the flow regulation valves $R_{cold}$ and $R_{hot}$ are configured as rotatable valve elements 98 which are each inserted into a cylindrical receiving space. The valve elements 98 get into the suction conduit 82 to a different extent or cover the connection channel 88, by way of rotation, so that the free flow cross section in the first or second flow path can be changed by way of rotating the respective valve element 98.

FIGS. 10 to 12 show an embodiment example of the circulation pump assembly 46 with the mixing device 44 as has been described by way of FIGS. 4 and 15. Here too, the mixing device 44 and the circulation pump assembly 46 represent an integrated construction unit. The drive motor 30 with the attached electronics casing 56 with regard to one construction corresponds to the drive motor 30 as has been described by way of FIGS. 7 to 9. The pump casing 78' with regard to its construction also corresponds essentially to the previously described pump casing 78. A first difference lies in the fact that the pump casing 78' has no flow regulation valves $R_{hot}$ and $R_{cold}$, wherein it is to be understood that such flow regulation valves R as have been described beforehand could also be provided in this second embodiment example. A second difference lies in the fact that the second suction pipe connection 86' in this embodiment example has an outer thread. However, it is to be understood that the suction pipe connection 86 according to the preceding embodiment example could also be configured accordingly or the suction pipe connection 86' could likewise comprise an inner thread.

In the second embodiment example, an impeller 100 is connected to the rotor shaft 66. This impeller 100 comprises a central suction port 102 whose peripheral edge is sealingly engaged with the ring element 92, so that a flow connection is created from the first suction pipe connection 84 into the impeller 100. The impeller 100 comprises only one blade ring which defines a first flow path departing from the suction port 102 which forms a first inlet opening, to the outer periphery of the impeller 100. This first flow path runs out into the delivery chamber 76 which is connected to the delivery pipe connection 80. An annular space 90, into which the connection channel 88 runs out from the second suction pipe connection 86 is again present surrounding the ring element 92. The impeller 100 comprises a front shroud 104. Openings 106 which form second inlet openings are formed in this shroud. These openings 106 run out into the flow channels 108 between the impeller blades. Here, the openings 106, seen radially with respect to the rotation axis X, run out into the flow channels 108 in a region between the suction port 102 and the outer periphery of the impeller 100. I.e. the openings 106 run out into a radial middle region of the first flow path through the impeller 100. The openings 106 and the flow channels 108 with their sections radially outside the openings 106 form second flow paths which correspond to the impeller part 50 as has been described by way of FIG. 4. The impeller part 78 is formed by the radially inwardly lying impeller part, i.e. in the flow direction between the suction port 102 and the openings 106. The openings 106 face the annular space 90 so that heating medium can enter these openings 106 via the connection channel 88. In this embodiment example, the mixing point 52 according to FIG. 4 therefore lies in the flow channels 106 at the outlet side of the opening 106.

The impeller 100 on its outer periphery, i.e. on the outer periphery of the shroud 104 comprises an axially directed collar 110 which bears on the inner periphery of the pump casing 78' and therefore seals the annular space with respect to the delivery chamber 76. A temperature regulation of the heating medium flow which is fed to the floor heating circuit 2 can be carried out as is described by way of FIGS. 4 and 15, with the circulation pump assembly 46 with an integrated mixing device 44 which is shown in FIGS. 10 to 12.

Concerning the three solutions according to the invention which are described by way of example, a regulation of the temperature has been described by way of adjusting the mixing ratio solely by way of speed change. However, it is to be understood that such a feed temperature regulation could also be realized in combination with an additional valve $R_{hot}$ in the feed conduit 18 and/or a valve $R_{cold}$ in the return conduit 16. Here, the valves $R_{hot}$ and $R_{cold}$ can possibly be coupled to one another or be commonly formed as a three-way valve. An electrical drive of these valves could be activated by a common control device 34 which also controls or regulates the speed of the drive motor 30. The mixing ratio and thereby the temperature in the feed conduit for the floor heating can therefore be regulated or controlled by way of the control of the valves together with the control of the speed of the drive motor 30. On the one hand a greater range of regulation can be achieved by way of this, and on the other hand losses can be reduced by way of larger valve opening degrees. Hence for example the speed only needs to be briefly increased, in order to admix an increased quantity of heated heat transfer medium.

The invention was described by way of the example of a heating facility. However, it is to be understood that the invention can also be applied in a corresponding manner in other applications, in which two fluid flows are to be mixed. One possible application for example is a system for adjusting the service water temperature as is common in booster pumps for service water supply, in so-called shower booster pumps.

While specific embodiments of the invention have been shown and described in detail to illustrate the application of the principles of the invention, it will be understood that the invention may be embodied otherwise without departing from such principles.

The invention claimed is:

1. A circulation pump assembly comprising:

a first inlet;

a second inlet;

an outlet;

an electrical drive motor;

an impeller arrangement which is driven by the drive motor; and which comprises at least one first flow path for increasing a pressure of a fluid and which is situated in a connection between the first inlet and the outlet and the impeller arrangement comprises at least one second flow path which is for increasing a pressure of a fluid and which is situated in a connection from the second inlet to the outlet, wherein the at least one first flow path and the at least one second flow path, are formed in a common impeller as the impeller arrangement, or are formed in at least two impellers as the impeller arrangement, which two impellers are arranged rotationally fixed to one another;

a control device configured to regulate a temperature at the outlet side of the pump assembly by adjusting a speed of the drive motor, dependent on a temperature signal detected at the outlet of the pump assembly.

2. A circulation pump assembly according to claim 1, wherein the at least one second flow path is formed by a section of the at least one first flow path.

3. A circulation pump assembly according to claim 1, wherein:

the impeller arrangement comprises a suction port as a first inlet opening, departing from which the at least one first flow path extends to an outlet side of the impeller arrangement; and the impeller arrangement comprises at least one second inlet opening which is situated between the suction port and the outlet side in a direction of the flow through the impeller arrangement and is connected to the second inlet of the circulation pump assembly.

4. A circulation pump assembly according to claim 3, wherein:

the at least one second inlet opening runs out into the at least one first flow path; and the section of the at least one first flow path forms the at least one second flow path between the at least one second inlet opening and the outlet side.

5. A circulation pump assembly according to claim 4, wherein:

several first flow paths are formed between impeller blades of the impeller arrangement; and the at least one second inlet opening runs out into each of the first flow paths between the impeller blades.

6. A circulation pump assembly according to claim 3, wherein the impeller arrangement comprises a plurality of second inlet openings.

7. A circulation pump assembly according to claim 6, wherein:

several first flow paths are formed between impeller blades of the impeller arrangement; and at least one of the second inlet openings runs out into each of the first flow paths between the impeller blades.

8. A circulation pump assembly according to claim 3, wherein the at least one second inlet opening is formed in a shroud which surrounds the suction port.

9. A circulation pump assembly according to claim 3, wherein the suction port is engaged with a stationary ring element having an interior, into which a flow connection from the first inlet runs out.

10. A circulation pump assembly according to claim 9, wherein:

an annular space, into which a flow connection from the second inlet runs out is formed at an outer periphery of the ring element; and the at least one second inlet opening faces the annular space.

11. A circulation pump assembly according to claim 1, wherein the impeller arrangement is in sealing engagement with a part of the surrounding pump casing radially outside the at least one second inlet opening.

12. A circulation pump assembly according to claim 1, further comprising a valve arranged in a flow connection between the second inlet and the impeller arrangement, for adjusting the flow rate through the flow connection.

13. A circulation pump assembly according to claim 12, wherein the valve comprises an electrical drive for changing a valve position.

14. A circulation pump assembly according to claim 1, further comprising a control device configured to adjust a speed of the drive motor.

15. A heating system comprising:

a first circulation pump assembly comprising a first inlet, a second inlet, an outlet, an electrical drive motor, and an impeller arrangement which is driven by the drive motor and which comprises at least one first flow path for increasing a pressure of a fluid and which is situated in a connection between the first inlet and the outlet and the impeller arrangement comprises at least one second flow path which is for increasing a pressure of a fluid and which is situated in a connection from the second inlet to the outlet, wherein the at least one first flow path and the at least one second flow path, are formed in a common impeller as the impeller arrangement, or are formed in at least two impellers as the impeller arrangement, which two impellers are arranged rotationally fixed to one another, the first circulation pump assembly further comprising a control device configured to regulate a temperature at the outlet side of the pump assembly by adjusting a speed of the drive motor, dependent on a temperature signal detected at the outlet of the pump assembly; and a second circulation pump assembly which is situated upstream of the second inlet of the first circulation pump assembly.

16. A heating system according to claim 15, wherein the control device is further configured to control the first circulation pump assembly and/or the second circulation pump assembly and/or a valve which is situated in the flow path from the second inlet to the impeller arrangement, to adjust a mixing ratio of the flows from the first inlet and the second inlet in the first circulation pump assembly.

17. A heating system according to claim 15, wherein the at least one second flow path is formed by a section of the at least one first flow path.

18. A heating system according to claim 15, wherein:

the impeller arrangement comprises a suction port as a first inlet opening, departing from which the at least one first flow path extends to an outlet side of the impeller arrangement; and the impeller arrangement comprises at least one second inlet opening which is situated between the suction port and the outlet side in a direction of the flow through the impeller arrangement and is connected to the second inlet of the circulation pump assembly.

19. A circulation pump assembly comprising:

a first inlet;

a second inlet;

an outlet;

a temperature sensor configured to provide a temperature sensor signal based on a temperature at the outlet;

an electrical drive motor;

an impeller arrangement which is driven by the drive motor, the impeller arrangement comprising at least one first flow path for increasing a pressure of a fluid and which is situated in a connection between the first inlet and the outlet and the impeller arrangement comprises at least one second flow path which is for increasing a pressure of a fluid and which is situated in a connection from the second inlet to the outlet, wherein the at least one first flow path and the at least one second flow path, are formed in a common impeller as the impeller arrangement, or are formed in at least two impellers as the impeller arrangement, which two impellers are arranged on a shaft such that the two impellers are configured to rotate based on rotation of the shaft;

a control device configured to receive the temperature signal as input and to regulate a temperature at the outlet side of the pump assembly by adjusting a speed of the drive motor based on the temperature signal.

20. A circulation pump assembly according to claim 19, wherein:

the impeller arrangement comprises a suction port as a first inlet opening, departing from which the at least one first flow path extends to an outlet side of the impeller arrangement;

the impeller arrangement comprises at least one second inlet opening which is situated between the suction port and the outlet side in a direction of the flow through the impeller arrangement and is connected to the second inlet of the circulation pump assembly; and the impeller arrangement comprises a plurality of second inlet openings.

* * * * *